US007699718B2

(12) United States Patent
Lindner

(10) Patent No.: US 7,699,718 B2
(45) Date of Patent: Apr. 20, 2010

(54) APPARATUS FOR WEIGHTING GOLF CLUB SHAFT

(75) Inventor: Jeffrey L. Lindner, Madison, AL (US)

(73) Assignee: Balance-Certified Golf, Inc., Huntsville, AL (US)

( * ) Notice: Subject to any disclaimer, the term of this patent is extended or adjusted under 35 U.S.C. 154(b) by 0 days.

(21) Appl. No.: 11/726,281

(22) Filed: Mar. 21, 2007

(65) Prior Publication Data

US 2007/0161431 A1 Jul. 12, 2007

Related U.S. Application Data

(63) Continuation-in-part of application No. 10/752,126, filed on Jan. 6, 2004, now Pat. No. 7,261,641.

(51) Int. Cl.
*A63B 53/16* (2006.01)

(52) U.S. Cl. ..... 473/297

(58) Field of Classification Search ..... 473/296–299, 473/294, 307; 411/34–35, 37; 403/109.5, 403/370, 351

See application file for complete search history.

(56) References Cited

U.S. PATENT DOCUMENTS

| | | | |
|---|---|---|---|
| 1,658,447 | A | 2/1928 | Lantz |
| 1,696,462 | A | 12/1928 | Victor |
| 1,704,544 | A | 3/1929 | Novak |
| 2,051,083 | A | 8/1936 | Hart |
| 3,539,185 | A | 11/1970 | Andis |
| 4,058,312 | A | 11/1977 | Stuff et al. |
| 4,461,479 | A | 7/1984 | Mitchell |
| 4,600,195 | A | 7/1986 | Hunter |
| 4,674,746 | A | 6/1987 | Benoit |
| 4,690,407 | A | 9/1987 | Reisner |
| 4,869,511 | A | 9/1989 | Spoonster, Sr. |
| 4,887,815 | A | 12/1989 | Hughes et al. |

(Continued)

FOREIGN PATENT DOCUMENTS

| | | |
|---|---|---|
| EP | 92306514.8 | 3/1993 |

(Continued)

OTHER PUBLICATIONS

The RandomHouse College Dictionary, 1975, p. 156.*

*Primary Examiner*—Stephen L. Blau
(74) *Attorney, Agent, or Firm*—Bradley Arant Boult Cummings LLP

(57) ABSTRACT

An apparatus for selectively adding weight to the hollow shaft of a hand-held implement. One embodiment includes an upper cylindrical member, a lower member, and an expansion ring that fits between the upper and lower members. These components are sized slightly smaller than the inside diameter of a hollow shaft, such as a golf club shaft. Each component includes an axial bore, through which a screw with an elongated barrel extends. The axial bore of the upper member is enlarged at its upper terminus to receive the cap of the screw, and the axial bore of the lower member is threaded to receive the screw. This assembly is inserted into a hollow shaft, and as the screw is tightened, the lower member is drawn into the upper member, compressing the expander ring axially causing it to expand radially until a friction fit with the inside surface of the hollow shaft is achieved.

11 Claims, 2 Drawing Sheets

U.S. PATENT DOCUMENTS

| | | | | |
|---|---|---|---|---|
| 4,936,586 | A | 6/1990 | Van Raemdonck | |
| 4,988,102 | A | 1/1991 | Reisner | |
| 5,277,059 | A | 1/1994 | Chastonay | |
| 5,285,696 | A * | 2/1994 | Taylor | 74/551.1 |
| 5,364,102 | A | 11/1994 | Appledorn | |
| 5,390,921 | A | 2/1995 | DeRuyter | |
| 5,465,967 | A | 11/1995 | Boeckenhaupt | |
| 5,716,289 | A | 2/1998 | Okoneski | |
| 5,722,899 | A | 3/1998 | Cheng | |
| 5,746,664 | A | 5/1998 | Reynolds, Jr. | |
| 5,766,088 | A | 6/1998 | Severtsen | |
| 5,871,140 | A | 2/1999 | McCrink | |
| 6,007,431 | A | 12/1999 | Bloom, Jr. | |
| 6,190,267 | B1 | 2/2001 | Marlowe et al. | |
| 6,364,787 | B1 | 4/2002 | Huiskamp | |
| 6,743,116 | B2 * | 6/2004 | Wilbur | 473/296 |
| 6,776,724 | B1 * | 8/2004 | Siemsglusz | 473/294 |
| 2005/0054459 | A1 * | 3/2005 | Oldenburg | 473/297 |
| 2006/0183563 | A1 * | 8/2006 | Nemeckay | 473/239 |
| 2007/0111815 | A1 * | 5/2007 | Cheng | 473/300 |
| 2007/0243947 | A1 * | 10/2007 | Cheng | 473/316 |

FOREIGN PATENT DOCUMENTS

| | | |
|---|---|---|
| EP | 92310738.7 | 6/1993 |
| EP | 0377673 B1 | 5/1997 |
| EP | 01304012.6 | 11/2001 |
| GB | 11118 | 0/1901 |

* cited by examiner

APPARATUS FOR WEIGHTING GOLF CLUB SHAFT

This application is a continuation-in-part of and claims the benefit of U.S. patent application Ser. No. 10/752,126, filed Jan. 6, 2004 now U.S. Pat. No. 7,261,641.

BACKGROUND

The present invention provides an apparatus for improving the dynamic response or feel of a golf club as it strikes a golf ball during play by selectively adding weight to the upper end of the shaft. Although there are many products and prior patents relating to adjusting the swing weight, feel, or balance of a golf club, few if any of these devices are directed towards improving the dynamic response, or feedback, of the club to the golfer at ball impact. Most prior art devices are aimed more specifically at the static or quasi-static feel of the club in the golfer's hand at the initial alignment, or during the back and forward swings. Such devices usually focus on the feel of the club itself, not the feel of the shot through the club. The importance of impact and dynamic response to the golfer's game are often overlooked.

Impact is momentary, but it is at and immediately following this critical moment that the golfer feels his shot through the dynamic response of the club. As many golfers will confess, after impact one often knows where the ball is heading without having to actually see its trajectory. The golfer has only one tactile interface to the club, and that is through his hands which grasp the club's shaft on the grip. It is thus through the golfer's hands gripping the shaft that the dynamic response of the club to the golfer's stroke is communicated. This dynamic response is a result of the vibration characteristics of the club, and the golfer often perceives it simply as feel. Thus it follows that if the club's dynamic response can be increased in this specific gripping area, the golfer will have a better feel for his shot.

The present invention provides an apparatus for improving the dynamic response of the golf club by allowing a golfer to selectively adjust the weight of the club at its grip end. This action in turn enhances the feel of the club to the golfer.

SUMMARY

One embodiment of the present invention comprises an upper cylindrical member and a lower member, an expander ring, and a screw. The upper and lower members, and the expansion ring, are slightly smaller in diameter than the inside diameter of a hollow shaft. The upper cylindrical member includes a post extending from the center of its lower surface and an axial bore through which the screw is passed. The lower member also includes a post extending from the center of its upper surface. The lower member includes a second axial bore extending through the second post and into the main body of the lower member. The second axial bore is threaded to receive the end of the screw. The expander ring, which is generally shaped like a hollow cylinder, fits between the upper and lower members snugly onto their respective posts. The screw extends through the first axial bore in the upper cylindrical member, through the center of the expander ring, and into the second axial bore in the lower member. The first axial bore has a portion of enlarged diameter at its upper terminus for receiving the cap of the screw. The assembly of the first and second members, the expander ring, and screw is inserted into a hollow shaft, such as a golf club shaft. As the screw is tightened into the lower member, it pulls the lower member towards the upper member and compresses the expander ring axially (i.e., longitudinally), causing it to expand radially. This radial expansion causes a portion of the outside surface of the expander ring to bear against the inside wall of the shaft, forming a friction fit to hold the device in place. In an alternative embodiment, the lower member includes an elongated, cylindrical extension extending upward from the second post, through the expander ring, and into the first axial bore of the upper member. The second axial bore extends through this extender, and the screw threads into it. In either embodiment, the second post (on the lower member) may have a diameter slightly larger than that of the first post (on the upper member) sufficient in size to cause the expander ring to expand radially when pressed onto the second post.

DESCRIPTION OF DRAWINGS

These and other features, aspects, structures, advantages, and functions are shown or inherent in, and will become better understood with regard to, the following description and accompanied drawings where.

DETAILED DESCRIPTION

The present invention relates to device for adding weight to the end of a hollow shaft for a hand-held implement, such as a golf club. A golf club shaft will be referred to herein as the exemplary application for the device, but it should be understood there are many other applications for the device as well.

Figure 1:
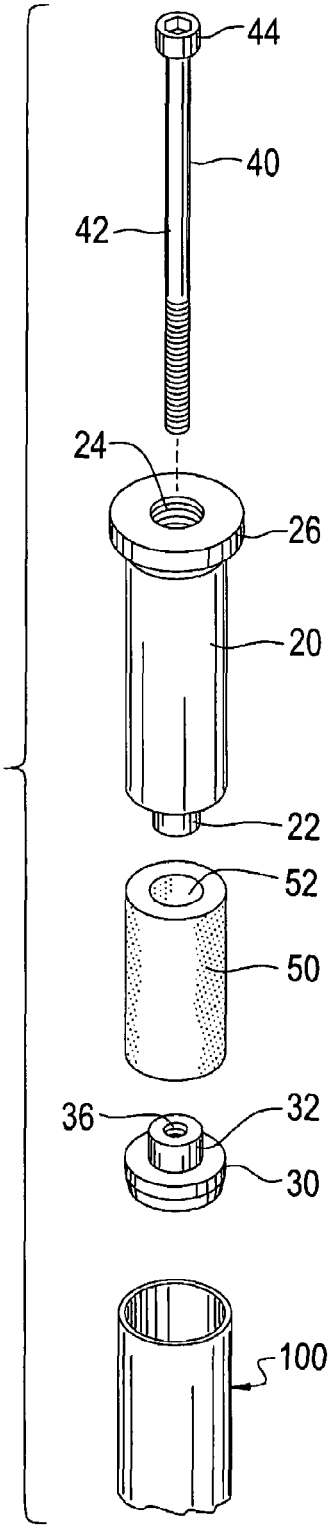
FIG. 1 is a perspective exploded view of one embodiment of the present invention.
Figure 2:
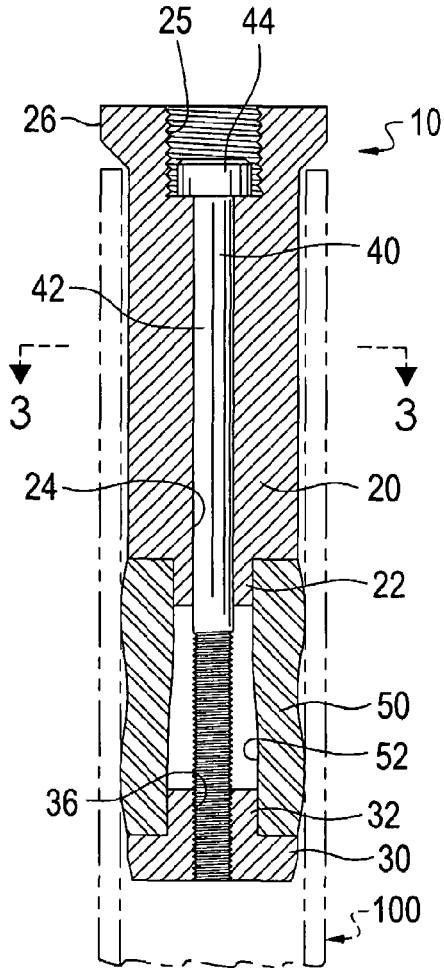
FIG. 2 is a side sectional view of the embodiment of FIG. 1 assembled and installed on a golf club shaft.
Figure 3:
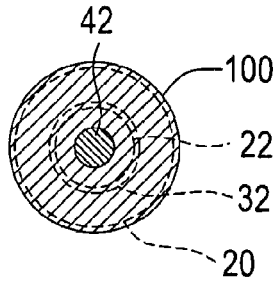
FIG. 3 is a cross sectional view of the assembly shown in FIG. 2.

One embodiment of the present invention is illustrated in FIGS. 1-3. As shown in FIGS. 1-2, the device 10 comprises an upper cylindrical member 20, a lower member 30, a screw 40, and an expander ring 50. As described in more detail below, the screw 40 extends through the upper member 20, through the expander ring 50 and into the lower member 30. When tightened, the screw 40 causes the lower member 30 to be drawn towards the upper member 20, thus compressing ring 50 and causing it to expand radially. This radial expansion creates a friction fit of the device 10 within a hollow shaft 100, as shown in FIG. 2.

The upper cylindrical member 20 includes a first post 22 extending down from its bottom surface. The first post 22 is concentric with (or coaxial with) the upper member 20. A first axial bore 24 extends through the upper member 20 including through the first post 22. The bore 24 is sized to receive the screw 40, with an enlarged portion near the upper terminus to receive the screw's cap 44 and the remainder sized to accommodate the screw's barrel 42. The upper cylindrical member 20 has a diameter slightly smaller than the inside diameter of the shaft 100 so that the device 10 may be inserted into the shaft 100, as shown in FIG. 2. The upper member 20 may include a flange 26 of a diameter approximating that of the outside of the shaft 100, so that flange 26 acts as a stop when the device 10 is inserted into the shaft 100. The flange 26 may be tapered as shown. Optionally, the side walls 25 of the enlarged portion of the bore 24 may be threaded to mate with an extraction tool to facilitate removal of the device 10 from the shaft 100.

The lower member 30, the main body of which will generally be of a cylindrical shape, includes a second post 32 extending up from its upper surface. The second post 22 is concentric with (or coaxial with) the lower member 30. A second axial bore 36 extends through the second post 32 and into the main body of the lower member 30. The second axial bore is threaded complementary to the threaded portion of the barrel 42 of screw 40. Depending on the length of the upper cylindrical member 20 and the screw 42, the second axial bore 36 may extend completely through the second member 30, as shown in FIG. 2. In other embodiments, the second axial bore may terminate short of the bottom of the lower member 30.

The expander ring 50 fits between the upper member 20 and the lower member 30. Specifically, the expander ring 50 is annular or hollow, with its inner void being referred to as a third axial bore 52. The third axial bore 52 is sized so that the expander ring 50 fits snugly onto the first post 22 and the second post 32. In a preferred embodiment, as shown in FIG. 3, the diameter of the second post 32 is larger than that of the first post 22 and is sufficient to force the expander ring 50 to expand radially when the ring 50 is pushed onto the second post 32. This expansion tends to prevent the lower member 30 from rotating as the screw is turned during installation and removal of the device 10 from the shaft 100.

Figure 4:
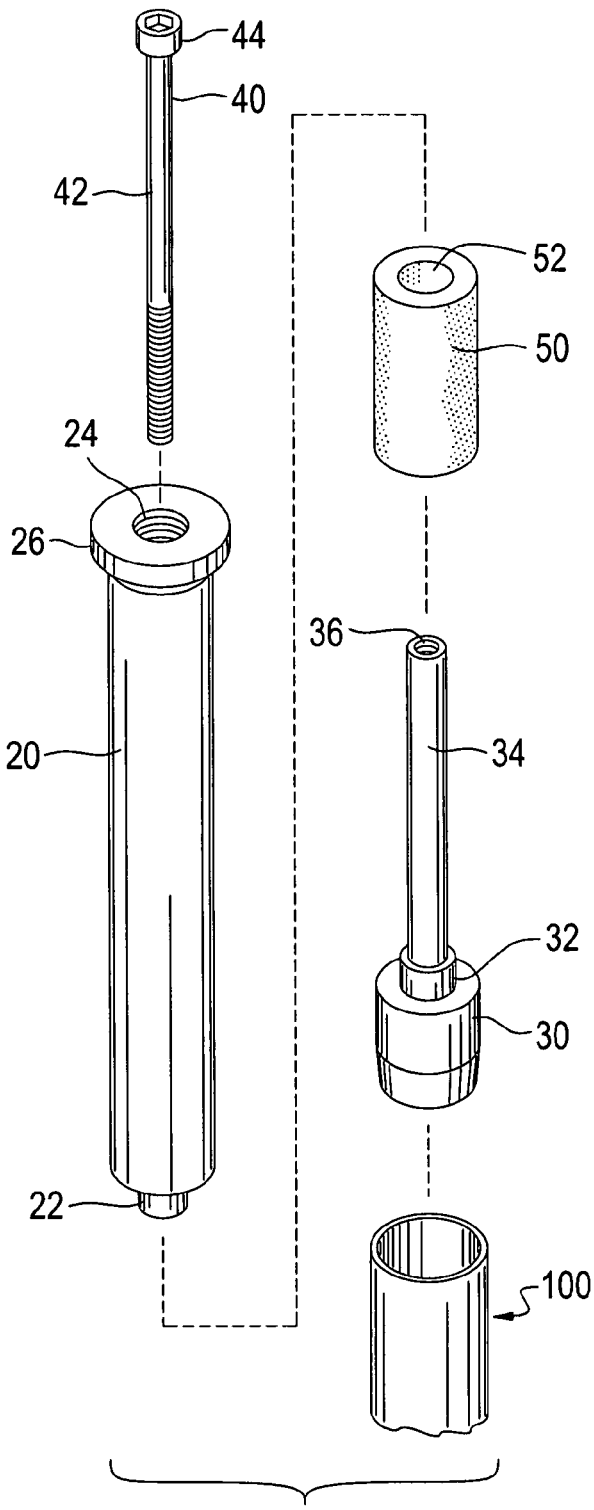
FIG. 4 is a perspective exploded view of another embodiment of the present invention.
Figure 5:
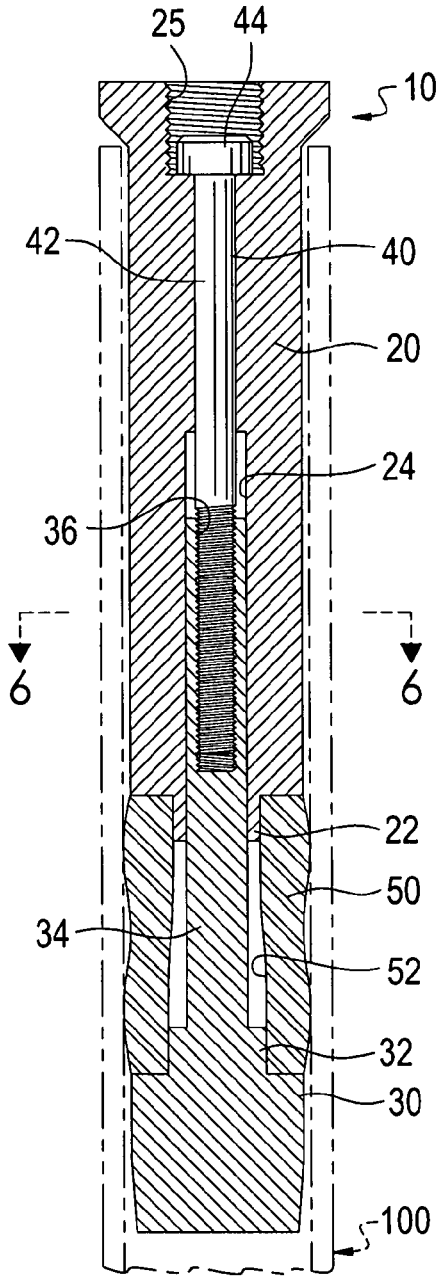
FIG. 5 is a side sectional view of the embodiment of FIG. 4 assembled and installed on a golf club shaft.
Figure 6:
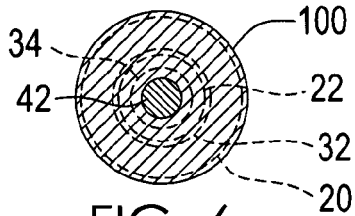
FIG. 6 is a cross sectional view of the assembly shown in FIG. 5.

An alternative embodiment is shown in FIGS. 4-6. This embodiment is utilized for heavier weights where the length of the upper cylindrical member 20, alone or in combination with the length of the expander ring 50, may exceed the length of the screw 40, as shown in FIG. 5. To accommodate this, the lower member 30 further comprises an elongate cylindrical extension 34, concentric with the second post 32, that extends up through the expander ring 50 and into the first axial bore 24 of the upper cylindrical member. In this embodiment, the axial bore 24 is enlarged slightly to receive the extension 34. The second axial bore 36 begins at the upper terminus of the extension 34 and extends axially of sufficient length to receive the barrel 42 of the screw 40. A portion of the second axial bore 36 is threaded as shown.

The upper and lower members 20 and 30 of the device 10 may be constructed from any suitably durable and rigid material, including metals such as brass, aluminum, lead, tungsten, titanium, stainless steel, nickel and their alloys. For simplicity, when a metal is identified herein, such as tungsten, such identification refers to the metal and its alloys known in the art. It is contemplated that composite materials also could be used. The component parts may be manufactured by any conventional machining, casting, molding, or other fabrication technology. Alloys of brass and aluminum are preferred for their relatively low cost, availability, durability, and ease with which they may be worked.

The expander ring 50 may be made from any deformable material with good durability, such as a polymer. The polymer material may be reinforced with a non-polymeric material, such as strands of nylon, to add strength and control the deformation characteristic.

In either embodiment, the principle of operation is the same. The expander ring 50 is mounted on the first and second posts of the upper and lower members 20 and 30, respectively. The screw 40 is inserted through the first axial bore 24 of the upper member 20 and is threaded a few turns into the second axial bore 36. This assembly is inserted into the hollow shaft 100 the desired distance, or, in an embodiment with a flange 26, until the flange 26 abuts the upper end of the shaft 100. (In the first embodiment the barrel 42 of the screw 40 extends through the third axial bore 52 of the expander ring 50, and in the second embodiment, the extension 34 extends through the third axial bore 52. In either case, the screw 40 threads into the second axial bore 36.) As the screw 40 is tightened into the second axial bore 36, the screw's cap 44 bears down on the shoulder formed at the terminus of the enlarged portion of the first axial bore 24 and the lower member 20 is pulled upwards. This screw action longitudinally compresses the expander ring 50 between the upper and lower members 20 and 30 causing the ring to expand radially. This expansion creates a secure friction fit of the device 10 within the shaft 100. The friction fit achieved by the expander ring 50 allows the dimensions of the upper and lower members 20 and 30 to be conservatively sized to fit shafts having varying internal diameters.

Devices 10 having a range of weights can easily be manufactured by making upper cylindrical members of varying lengths or of materials of varying densities (e.g., tungsten, brass, aluminum), or a combination of the two. The device 10 is easily inserted into and secured in a club without the use of adhesives. After loosening the screw 40, the device 10 may be easily extracted from a club by threading an extraction tool into the threads 25 on the upper portion of the first axial bore 24 and pulling. In this way, a range of weights can be tested until a weight providing optimum feel for a given club is selected.

Although the present invention has been described and shown in considerable detail with reference to certain preferred embodiments thereof, other embodiments are possible. The foregoing description is therefore considered in all respects to be illustrative and not restrictive. Therefore, the present invention should be defined with reference to the claims and their equivalents, and the spirit and scope of the claims should not be limited to the description of the preferred embodiments contained herein.

I claim:

1. A device for adding weight to a hollow shaft of a hand-held implement, said device comprising:

a screw comprising an elongate barrel, at least part of which is threaded, and a cap larger in diameter than said barrel;

an upper cylindrical member having an upper surface, a lower surface, and side walls, said upper cylindrical member being slightly smaller in diameter than the inside diameter of said hollow shaft and comprising a first post extending from the lower surface of said upper cylindrical member and being concentric therewith, and a first axial bore, slightly larger in diameter than the barrel of said screw, extending through said upper cylindrical member including through said first post, wherein an upper portion of said first bore is enlarged to receive the cap of said screw;

a lower member having an upper surface, a lower surface, and side walls, said lower member being slightly smaller in diameter than the inside diameter of said hollow shaft and comprising a second post larger in diameter than said first post extending from the upper surface of said lower member and being concentric therewith, and a second axial bore, sized and threaded to receive the barrel of said screw, extending through said second post and into said lower member; and an expansion ring slightly smaller in diameter than the inside diameter of said hollow shaft, located between said upper cylindrical member and said lower member, said ring made of a deformable material, and having a third axial bore therethrough sized to fit snugly onto said first post and to expand radially when fit onto said second post;

wherein the barrel of said screw extends through said first and third bores and is threaded into said second axial bore, seating the cap of said screw into the enlarged portion of said first axial bore, such that when said device is inserted into said hollow shaft and said screw is tightened, said cylindrical member and said lower member axially compress said ring and cause it to expand radially against the inner wall of said hollow shaft, thereby fixing the position of said device within said shaft.

2. The device of claim 1, wherein said upper cylindrical member further comprises a flange extending from its upper surface, said flange being larger in diameter than the inside diameter of said hollow shaft.

3. The device of claim 2, wherein said flange is tapered.

4. The device of claim 1, wherein the wall of the enlarged portion of said first bore is threaded to receive a complementarily threaded extraction tool to facilitate removal of said device from said shaft.

5. The device of claim 1, wherein said expansion ring is made of a polymeric material.

6. The device of claim 5, wherein said polymeric material is reinforced with a nonpolymeric material to decrease its deformity.

7. A device for adding weight to a hollow shaft of a golf club, said device comprising:

a screw comprising an elongate barrel, at least part of which is threaded, and a cap larger in diameter than said barrel;

an upper cylindrical member having an upper surface, a lower surface, and side walls, said upper cylindrical member being slightly smaller in diameter than the inside diameter of said hollow shaft and comprising a first post extending from the lower surface of said upper cylindrical member and being concentric therewith, and a first axial bore, slightly larger in diameter than the barrel of said screw, extending through said upper cylindrical member including through said first post, wherein an upper portion of said first bore is enlarged to receive the cap of said screw, the wall of the enlarged portion being threaded to receive a complementarily threaded extraction tool to facilitate removal of said device from said shaft;

a lower member having an upper surface, a lower surface, and side walls, said lower member being slightly smaller in diameter than the inside diameter of said hollow shaft and comprising a second post extending from the upper surface of said lower member and being concentric therewith, and a second axial bore, sized and threaded to receive the barrel of said screw, extending through said second post and into said lower member; and an expansion ring slightly smaller in diameter than the inside diameter of said hollow shaft, located between said upper cylindrical member and said lower member, said ring made of a deformable material, and having a third axial bore therethrough sized to fit snugly onto said first and second posts;

wherein the barrel of said screw extends through said first and third bores and is threaded into said second axial bore, seating the cap of said screw into the enlarged portion of said first axial bore, such that when said device is inserted into said hollow shaft and said screw is tightened, said cylindrical member and said lower member axially compress said ring and cause it to expand radially against the inner wall of said hollow shaft, thereby fixing the position of said device within said shaft.

8. A device for adding weight to a hollow shaft of a golf club, said device comprising:

a screw comprising an elongate barrel, at least part of which is threaded, and a cap larger in diameter than said barrel;

an upper cylindrical member having an upper surface, a lower surface, and side walls, said upper cylindrical member being slightly smaller in diameter than the inside diameter of said hollow shaft and comprising a first post extending from the lower surface of said upper cylindrical member and being concentric therewith, and a first axial bore, slightly larger in diameter than the barrel of said screw, extending through said upper cylindrical member including through said first post, wherein an upper portion of said first bore is enlarged to receive the cap of said screw;

a lower member having an upper surface, a lower surface, and side walls, said lower member being slightly smaller in diameter than the inside diameter of said hollow shaft and comprising a second post extending from the upper surface of said lower member and being concentric therewith, and a second axial bore, sized and threaded to receive the barrel of said screw, extending through said second post and into said lower member; and an expansion ring slightly smaller in diameter than the inside diameter of said hollow shaft, located between said upper cylindrical member and said lower member, said ring made of a deformable material, and having a third axial bore therethrough sized to fit snugly onto said first and second posts, said second post being larger in diameter than first post and of sufficient size to radially expand said expansion ring when it is fitted thereon;

wherein the barrel of said screw extends through said first and third bores and is threaded into said second axial bore, seating the cap of said screw into the enlarged portion of said first axial bore, such that when said device is inserted into said hollow shaft and said screw is tightened, said cylindrical member and said lower member axially compress said ring and cause it to expand radially against the inner wall of said hollow shaft, thereby fixing the position of said device within said shaft.

9. The device of claim 8, wherein said expansion ring is made of a polymeric material.

10. The device of claim 9, wherein said polymeric material is reinforced with a nonpolymeric material to decrease its deformity.

11. A device for fixing a mass within a hollow shaft of a hand-held implement, said device comprising:

a screw comprising an elongate barrel, at least part of which is threaded, and a cap larger in diameter than said barrel;

an upper member sized to fit within said shaft, and comprising a first post, coaxial with said member and extending downward therefrom, and a first axial bore, slightly larger in diameter than the barrel of said screw, extending through said upper member including through said first post;

a lower member sized to fit within said shaft and comprising a second post, coaxial with said lower member and extending upward from said lower member, and a second axial bore extending through said second post and into said lower member and sized and threaded to receive the barrel of said screw; and a deformable expansion ring located between said upper cylindrical member and said lower member, said ring sized to fit within said hollow shaft when in an non-deformed state and sized to fit snugly onto said posts, wherein said second post is larger in diameter than said first post, causing said ring to expand radially when fit onto said second post;

wherein the barrel of said screw extends through said first bore and said ring and is threaded into said second axial bore, with the cap of said screw bearing against the upper member, such that when said device is inserted into said hollow shaft and said screw is tightened, said upper and lower members axially compress said ring and cause it to expand radially against the inner wall of said hollow shaft.

* * * * *